US006296176B1

(12) United States Patent
Frenois et al.

(10) Patent No.: US 6,296,176 B1
(45) Date of Patent: Oct. 2, 2001

(54) BOX WITH REINFORCED CLOSURE

(75) Inventors: Chrystel Frenois, Montesson; Philippe Renault, Chaville, both of (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/610,291

(22) Filed: Jul. 5, 2000

(30) Foreign Application Priority Data

Jul. 9, 1999 (FR) ..... 99 08953

(51) Int. Cl.[7] ..... B65D 5/10
(52) U.S. Cl. ..... 229/153; 206/807; 229/102
(58) Field of Search ..... 229/102, 153; 206/807

(56) References Cited

U.S. PATENT DOCUMENTS

| | | | | |
|---|---|---|---|---|
| 1,986,145 | * | 1/1935 | Goodyear | 229/153 |
| 2,041,932 | * | 5/1936 | Hutchins, Jr. | 206/807 |
| 2,116,652 | * | 5/1938 | Adler | 229/153 |
| 2,986,323 | * | 5/1961 | Wichman | 229/153 |
| 3,194,475 | * | 7/1965 | Ralston | 229/153 |
| 3,578,154 | * | 5/1971 | Martelli | 229/153 |
| 4,890,789 | * | 1/1990 | Lo Duca | 229/102 |
| 5,207,374 | * | 5/1993 | Lo Duca | 206/807 |

FOREIGN PATENT DOCUMENTS

| | | |
|---|---|---|
| U1-93 18 993 | 2/1994 | (DE) . |
| U1-296 20 217 | 1/1997 | (DE) . |
| A1-0 318 750 | 7/1989 | (EP) . |
| 289127 | 10/1927 | (GB) . |

* cited by examiner

*Primary Examiner*—Gary E. Elkins
(74) *Attorney, Agent, or Firm*—Oliff & Berridge, PLC

(57) ABSTRACT

A box with two side panels, a front panel, a rear panel and at least one opening has two side flaps extending the side panels and a closure flap extending the rear panel. The closure flap has a tongue with a projecting abutment-forming surface. Each of the side flaps have cutout areas designed to interface with the tongue of the closure flap in such a manner as to facilitate insertion of the tongue between the front panel and the side flaps and resist removal of the tongue once insertion is completed.

35 Claims, 3 Drawing Sheets

BOX WITH REINFORCED CLOSURE

The present invention relates to a box, more particularly to a box of the type comprising a body of square or rectangular section having a front panel and a rear panel interconnected by two side panels, the side panels and the front and rear panels being made by folding a sheet material, the body of the box having at least one opening with an associated closure device.

BACKGROUND OF THE INVENTION

European patent EP-B1-0 318 750 discloses a box in which the closure device comprises firstly two side flaps extending via folds from each of the side panels, each side flap having a front edge situated adjacent to the front longitudinal panel, and secondly a closure flap comprising a cover-forming portion designed to be folded down onto the side flaps and implemented by extending the rear panel via a fold. The closure flap also has a tongue extending the cover-forming portion via a fold. The cover-forming portion thus has one end connected to the rear panel and another end connected to the tongue. On closure, the tongue is designed to be inserted between the front panel and the front edges of the side flaps.

In order to provide reinforced closure, a slot is formed in the distal end of the cover-forming portion and the side flaps are arranged to lie one on the other prior to the closure flap being put into place, and they have teeth for engaging in the above-mentioned slot when the closure device is in its closed configuration.

Such a reinforced closure device is not entirely satisfactory in terms of appearance because the slot made in the distal end of the cover-forming portion remains visible after the box has been closed. That device is therefore not suitable for closing the top opening of the box since the slot would be easily seen by a consumer when the box is on display on a shelf.

In addition, the slot is liable to act as a tear starter.

There thus exists a need for a reinforced closure device that ensures that the outside appearance of the box is satisfactory.

Such a reinforced closure device should make the box more difficult to open and should serve, for example, to prevent a consumer finding it easy to open the box, try out its contents, and then reclose the box.

Utility model DE-U-29 620 217 discloses a box comprising a body having a front panel and a rear panel interconnected by two side panels, the side panels and the front and rear panels being made by folding a sheet material, the body of the box having at least one opening with an associated closure device, said closure device comprising two side flaps each extending a respective side panel via a respective fold, each side flap having a front edge situated adjacent the front panel, the closure device also comprising a closure flap formed to extend with the rear panel, said closure flap having a cover-forming portion for folding down onto the side flaps and a tongue for inserting between the front panel and the front edges of the side flaps when the closure device is in its closed configuration, the tongue having an inside face situated facing the rear panel when the closure device is in its closed configuration, the tongue including at least one abutment-forming surface beside its inside face and suitable for projecting beneath the side flaps when the closure device is in its closed configuration.

There exists a need to improve a box of that type, in particular in order to make it easier to assemble.

OBJECTS AND SUMMARY OF THE INVENTION

In the box of the invention, each side flap has a cutout in its front edge facilitating insertion of the tongue between the front panel and the side flaps.

By means of the cutouts formed in the side flaps, they deform more easily, and where appropriate this makes it easier to put the tongue into place.

Preferably, each cutout defines a first tab in that region of each side flap which is adjacent to its distal edge and to its front edge, beneath which tab the abutment-forming surface is suitable for coming into abutment.

Advantageously, each cutout defines a second tab in that region of each side flap which is adjacent to its proximal end and to its front edge, beneath which tab the abutment-forming surface is suitable for coming into abutment.

Preferably, the tongue includes a cutout in the middle of its distal edge to define on either side thereof outwardly extending portions suitable for engaging in the gaps formed between the cutouts in the side flaps and the front panel.

Thus, the tongue can be partially engaged between the side flaps and the front panel before meeting them, thereby making it easier to put into place.

Advantageously, the side flaps are independent of the closure flap, thereby making the box easier to assemble than that described in utility model DE-U29-620 217 where each of the side flaps is connected via a fold line to the closure flap, and they need to be folded diagonally during assembly of the box.

Advantageously, the side flaps are arranged to fold down into the opening of the body of the box without overlapping each other.

Thus, the abutment-forming surface of the tongue can bear in substantially uniform manner beneath the two side flaps, whereas if the side flaps are superposed, the abutment-forming surface would bear more against one of the side flaps, which is not desirable.

In addition, superposed side flaps give rise to an appearance that is relatively unpleasing since that makes the packaging less harmonious.

Preferably, the distal edges of the side flaps come substantially into contact with each other when the closure device is in its closed configuration.

Preferably, the abutment-forming surface of the tongue extends over substantially the entire width thereof.

Also preferably, the abutment-forming surface of the tongue is situated close to the distal end of the cover-forming portion.

The abutment-forming surface thus bears against the undersides of the side flaps after the tongue has finished being inserted between the front panel and the front edges of the side flaps.

In a particular embodiment, the abutment-forming surface of the tongue is constituted by an extra thickness of the closure flap.

In this particular embodiment, the closure flap can be twice as thick in the tongue as it is in the cover-forming portion.

In another particular embodiment, the abutment-forming surface is constituted by a portion of the tongue that is folded onto itself.

Advantageously, the body of the box has a second opening, said second opening being provided with an associated closure device, optionally identical to the first closure device.

The box is made by cutting out, folding, and sticking together a sheet of optionally-plasticized card, that is preferably at least 2 mm thick.

BRIEF DESCRIPTION OF THE DRAWINGS

Other characteristics and advantages of the present invention will appear on reading the following detailed description of non-limiting embodiments of the invention, and on examining the accompanying drawings, in which.

MORE DETAILED DESCRIPTION

Figure 1:
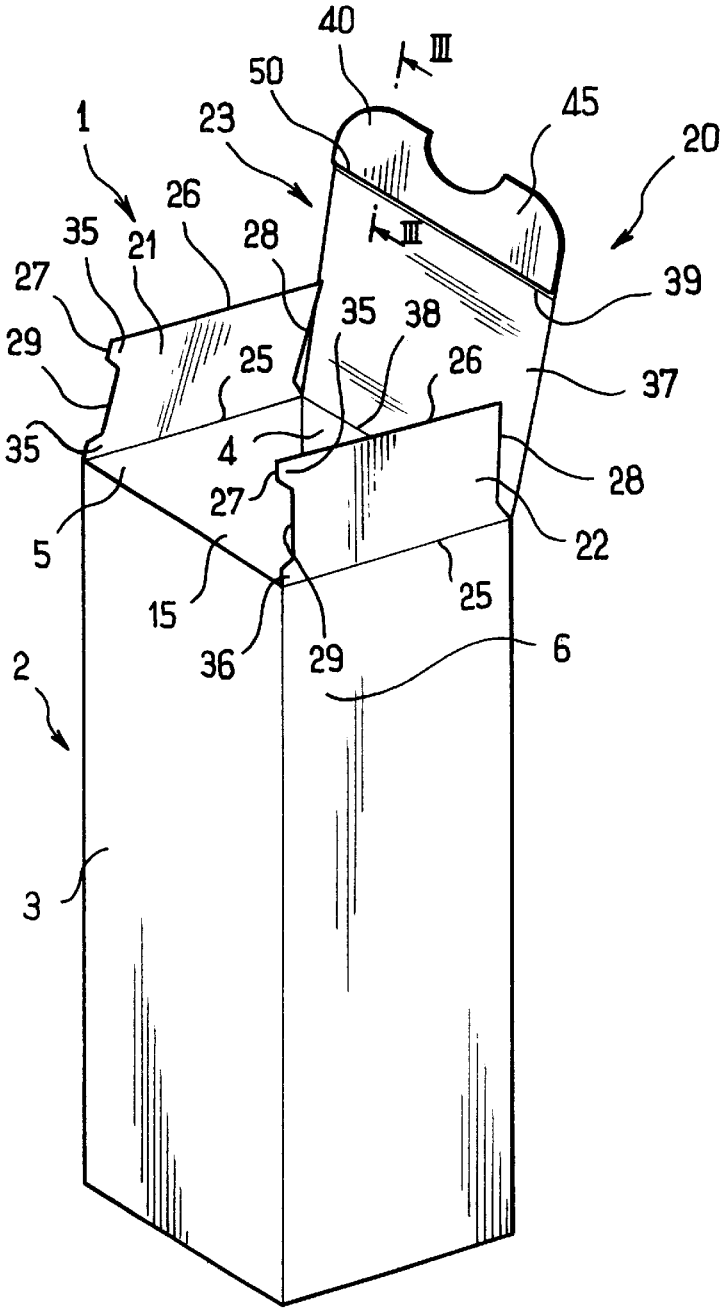
FIG. 1 is a diagrammatic perspective view of a box of the invention.
Figure 3:
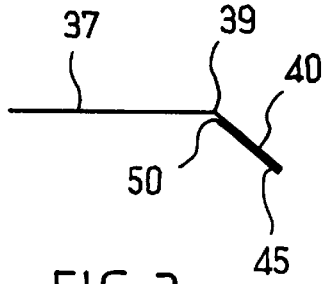
FIG. 3 is a section through the closure flap in a plane parallel to the side panels, showing extra thickness in the tongue.

The box 1 shown in FIGS. 1 and 3 comprises a body 2 of vertically elongate shape, of substantially square cross-section, comprising a front longitudinal panel 3 and a rear longitudinal panel 4 that are interconnected by two side panels 5 and 6.

Figure 2:
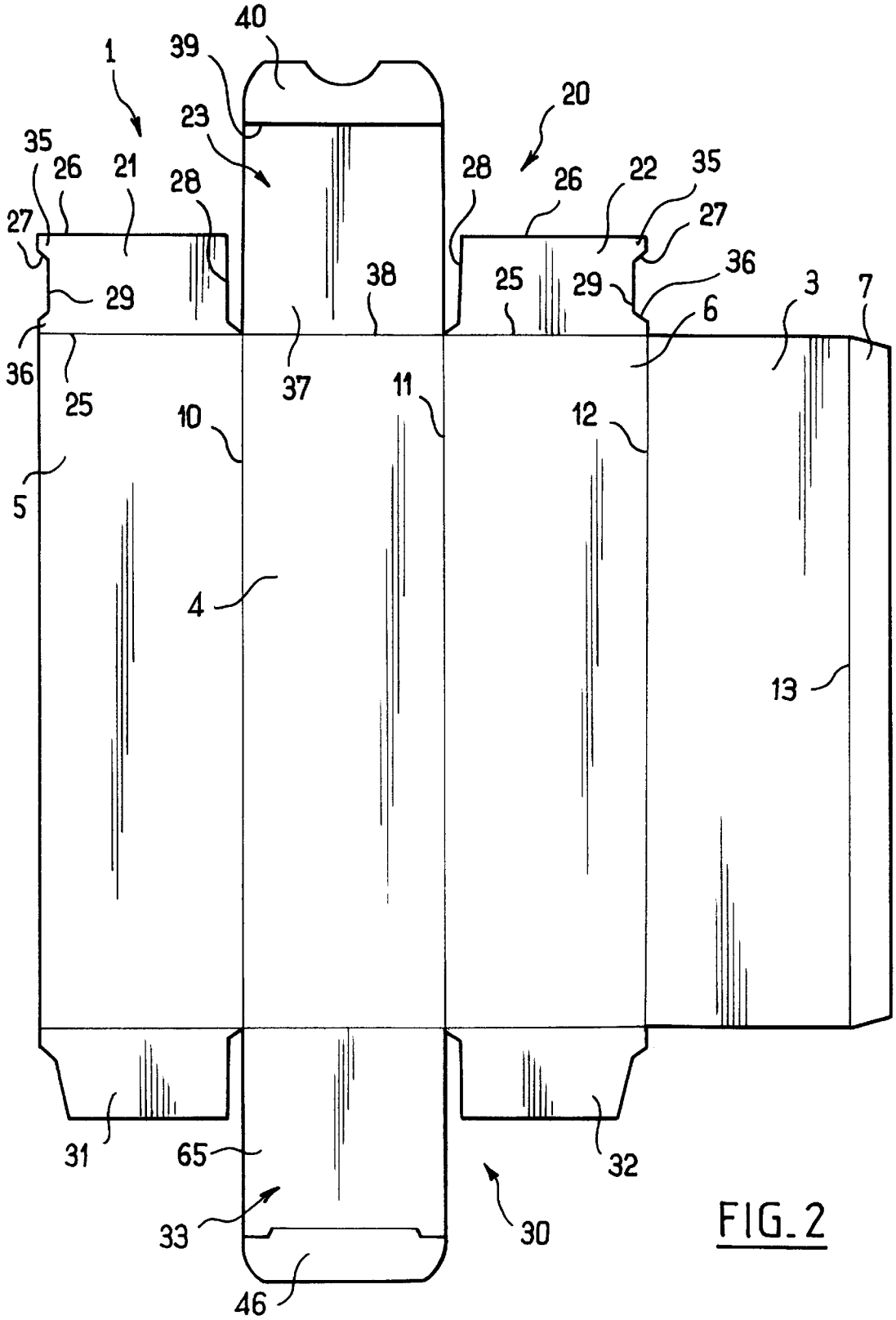
FIG. 2 shows the box prior to folding of the sheet material from which it is made.

The body 2 is made by cutting out and folding a sheet material, e.g. optionally-plasticized card carrying decoration on the outside, and as shown in FIG. 2.

An assembly strip 7 is made along one side of the front panel 3.

This assembly strip 7 is stuck to the side panel 5 so as to form the body 2 after the sheet material has been folded about parallel fold lines 10, 11, and 12 respectively connecting the rear panel 4 to the left side panel 5, the right side panel 6 to the rear panel 4, and the front panel 3 to the side panel 6.

The assembly strip 7 is connected to the front panel 3 via a fold line 13 parallel to the above-mentioned fold lines 10, 11, and 12.

In the example shown, the body 2 of the box has a top opening 15 and a bottom opening (not shown in FIG. 1), with a closure device 20 being associated with the top opening 15 and a closure device 30 being associated with the bottom opening.

The closure device 20 comprises two side flaps 21 and 22 formed respectively to extend the tops of the side panels 5 and 6 and a closure flap 23 formed to extend the top of the rear panel 4 between the side flaps 21 and 22.

In similar manner, the closure device 30 comprises two side flaps 31 and 32 respectively formed to extend the bottoms of the side panels 5 and 6 and a closure flap 33 formed to extend the bottom of the rear panel 4.

Each side flap 21 or 22 has a proximal end 25 whereby it is connected to the associated side panel, said proximal end coinciding with a fold line that can be seen in FIG. 2 to be perpendicular to the fold lines 10 to 13.

Each side flap 21 or 22 also has a distal edge 26 remote from its proximal end 25, a front edge 27 connecting the proximal end 25 to the distal edge 26 and adjacent to the front panel 3 once the box body 2 has been assembled, and a rear edge 28 opposite from the front edge 27.

In its middle region, each front edge 27 has a cutout 29 defining a first tab 35 in that region of each side flap which is adjacent to the front edge 27 and to the distal end 26, and a second tab 36 in that region which is adjacent to the proximal end 25 and to the front edge 27.

The closure flap 23 has a cover-forming portion 37 with a proximal end 38 whereby it is connected to the rear panel 4 and a distal end 39 whereby it is connected to a tongue 40.

The proximal and distal ends 38 and 39 coincide with parallel fold lines that can be seen in FIG. 2 to be perpendicular to the fold lines 10 to 13.

The closure flap 33 of the closure device 30 also has a cover-forming portion 65 provided on its side remote from the rear panel 4 with a tongue 46.

Figure 5:
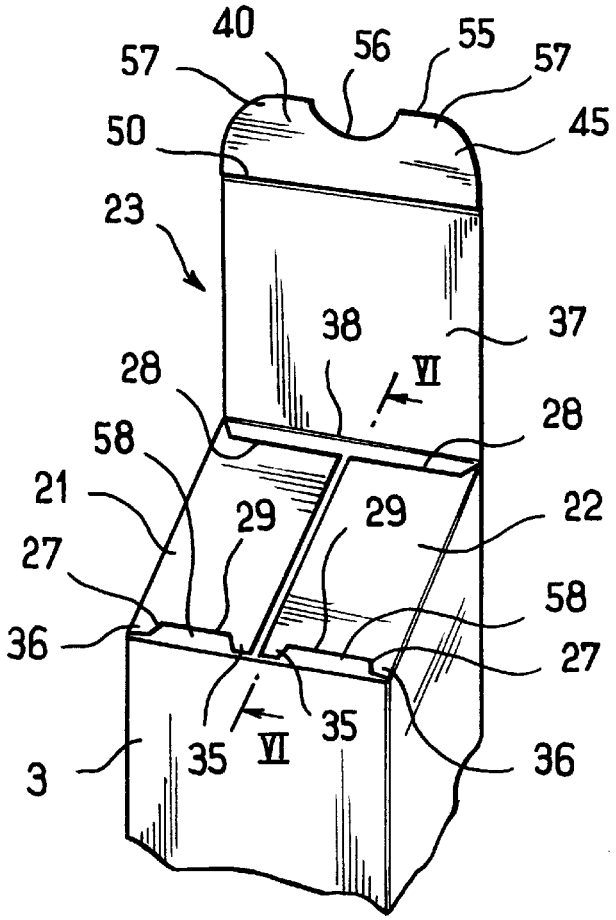
FIG. 5 shows the positioning of the side flaps prior to the closure flap being put into place.

To bring the closure device 20 into its closed configuration, the side flaps 21 and 22 are placed to overlie the opening 15, as shown in FIG. 5, and then the closure flap 23 is folded down onto the side flaps 21 and 22.

While the closure flap 23 is being lowered, its tongue 40 is inserted between the front panel 3 and the front edges 27 of the side flaps 21 and 22.

The tongue 40 then presents inside the box an inside face 45 facing the rear panel 4, and beside said inside face 45, an abutment-forming surface 50 suitable for bearing against the undersides of the side flaps 21 and 22 so as to oppose opening of the closure flap 23.

More particularly, in the example described, the abutment-forming surface 50 is constituted by a step formed by extra thickness of the cover-forming flap 23 where it constitutes the tongue 40, which extra thickness can be implemented by sticking a second sheet onto a first sheet that has been used for making the body of the box.

In a variant, the extra thickness can be formed by folding and sticking down onto itself an additional portion of the sheet that is used for making the body of the box.

Figure 6:
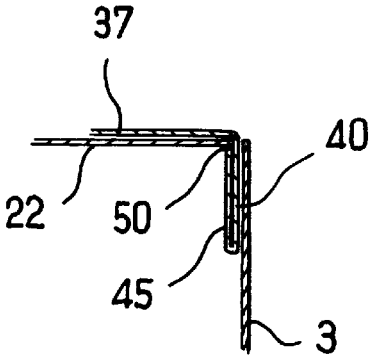
FIG. 6 is a section through the front top portion of the box in a section plane parallel to the side panels and showing the relative positions of the tongue and of the side flaps when the box is closed.

When the opening 15 is closed, the abutment-forming surface 50 bears against the undersides of the first tabs 35 and against the undersides of the second tabs 36 of the side flaps, as shown in FIG. 6.

The abutment-forming surface 50 thus opposes opening of the box, and in order to disengage the cover-forming flap 23 it is necessary to apply force to it so as to deform the first tabs 35 and the second tabs 36 in order to allow the tongue 40 to move past the front edges of the side flaps 21 and 22.

The distal edge 55 of the tongue 40 advantageously includes a cutout 56 in its central region, as shown in the figures, thereby defining two advanced portions 57 on either side thereof for engaging in the gaps 58 that are formed by the cutouts 29 in the side flaps 21 and 22 and the front panel 3, thus making the tongue 40 easier to put into place.

The rear edges 28 of the side flaps 21 and 22 are advantageously cut out so as to be set back a little, as shown in the figures.

When the closure device 30 is in its closed configuration, the side flaps 31 and 32 have been folded into the bottom opening, and the closure flap 33 has been folded down onto them, with the tongue 46 being engaged between the side flaps 31 and 32 and the front panel 3.

Naturally, the invention is not limited to the particular embodiment described above.

In particular, it is possible to make the abutment-forming surface in a manner other than assembling together two thicknesses of sheet material.

Figure 4:
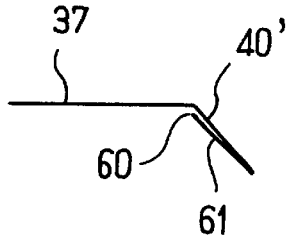
FIG. 4 is a view analogous to FIG. 3 showing a variant embodiment.

By way of example, FIG. 4 shows a tongue 40' having an abutment-forming surface 60 on its inside face which is formed by folding down a portion 61 of the tongue 40' onto itself, with the abutment-forming surface 60 thus being constituted by the free edge of the folded-down end 61.

Figure 7:
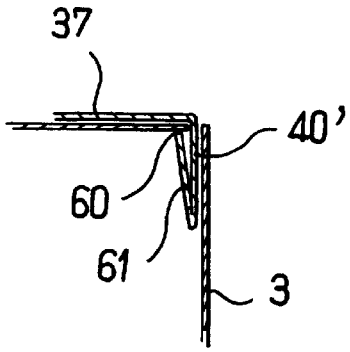
FIG. 7 is a view analogous to FIG. 6, when the abutment-forming surface is constituted by a portion of the tongue that is folded down onto itself.

As shown in FIG. 7, the abutment-forming surface 60 comes to bear against the undersides of the side flaps 21 and 22 when the box is closed.

What is claimed is:

1. A box comprising a body having a front panel and a rear panel interconnected by two side panels, the side panels and the front and rear panels being made by folding a sheet material, the body of the box having at least one opening with an associated closure device, said closure device comprising two side flaps each extending the respective lateral panel via a respective fold, each side flap having a front edge situated adjacent to the front panel, the closure device also comprising a closure flap formed to extend the rear panel, said closure flap having a cover-forming portion for folding down onto the side flaps and a tongue for inserting between the front panel and the front edges of the side flaps when the closure device is in its closed configuration, the tongue having two extending tabs with a cutout between them and an inside face facing the rear panel when the closure device is in its closed configuration, the tongue including at least one projecting abutment-forming surface beside the inside face of the tongue and suitable for projecting beneath the side flaps when the closure device is in its closed configuration, wherein each side flap has a cutout in its front edge facilitating insertion of the respective extending tab of the tongue between the front panel and the side flaps.

2. A box according to claim 1, wherein the cutout of each side flap defines a tab in a region of each side flap which is adjacent to a distal edge of said side flap and to a front edge of said side flap, beneath which tab the abutment-forming surface is suitable for coming into abutment.

3. A box according to claim 1, wherein the cutout of each side flap defines a tab in a region of each side flap which is adjacent to a proximal end of said side flap and to a front edge of said side flap, beneath which tab the abutment-forming surface is suitable for coming into abutment.

4. A box according to claim 1, wherein the side flaps are independent of the closure flap.

5. A box according to claim 1, wherein the side flaps are arranged to fold down into the opening of the body of the box without overlapping each other.

6. A box according to claims 5, in which each side flap is connected via a proximal end to the associated side panel, and has a distal edge, and wherein the distal edges of the side flaps come substantially into contact when the closure device is in its closed configuration.

7. A box according to claim 1, wherein the abutment-forming surface extends over substantially the entire width of the tongue.

8. A box according to claim 1, in which the cover-forming portion is connected via a proximal end to the rear panel and via a distal end to the tongue, and wherein the abutment-forming surface is situated close to the distal end of the cover-forming portion.

9. A box according to claim 1, wherein the abutment-forming surface is constituted by an extra thickness of the closure flap.

10. A box according to claim 9, wherein the thickness of the closure flap in its tongue portion is twice its thickness in its cover-forming portion.

11. A box according to claim 1, wherein the abutment-forming surface is constituted by a portion of the tongue that is folded down onto itself.

12. A box according to claim 1, wherein the body of the box has a second opening with a second associated closure device identical to the the at least one open with the associated closure device.

13. A box according to claim 1, wherein the material of the box is a card sheet, that is at least 2 mm thick.

14. A box according to claim 13, wherein said card sheet is plasticized.

15. A box according to claim 1, in which the cover forming portion is connected via a proximal end to the rear panel and via a distal end to the tongue, and wherein the abutment-forming surface is situated close to the distal end of the cover-forming portion.

16. A box comprising a body having a front panel and a rear panel interconnected by two side panels, the side panels and the front and rear panels being made by folding a sheet material, the body of the box having at least one opening with an associated closure device, said closure device comprising two side flaps each extending the respective lateral panel via a respective fold, each side flap having a front edge situated adjacent to the front panel, the closure device also comprising a closure flap formed to extend the rear panel, said closure flap having a cover-forming portion for folding down onto the side flaps and a tongue for inserting between the front panel and the front edges of the side flaps when the closure device is in its closed configuration, the tongue having an inside face situated facing the rear panel when the closure closure device is in its closed configuration, the tongue including at least one abutment-forming surface beside the inside face of the tongue and suitable for projecting beneath the side flaps when the closure device is in its closed configuration, wherein the abutment-forming surface is constituted by an extra thickness of the tongue.

17. A box according to claim 16, wherein each side flap has a cutout which defines a tab in a region of each side flap which is adjacent to a distal edge of said side flap and to a front edge of said side flap, beneath which tab the abutment-forming surface is suitable for coming into abutment.

18. A box according to claim 16, wherein each side flap has a cutout which defines a tab in a region of each side flap which is adjacent to a proximal end of said side flap and to a front edge of said side flap, beneath which tab the abutment-forming surface is suitable for coming into abutment.

19. A box according to claim 16, wherein the side flaps are independent of the closure flap.

20. A box according to claim 16, wherein the side flaps are arranged to fold down into the opening of the body of the box without overlapping each other.

21. A box according to claim 20, in which each side flap is connected via a proximal end to the associated side panel, each side flap has a distal edge, and wherein the distal edges of the side flaps come substantially into contact when the closure device is in its closed configuration.

22. A box according to claim 16, wherein the abutment-forming surface extends over substantially the entire width of the tongue.

23. A box according to claim 16, wherein the thickness of the closure flap in its tongue portion is twice its thickness in its cover-forming portion.

24. A box according to claim 16, wherein the body of the box has a second opening and an associated closure device identical to the first.

25. A box according to claim 16, wherein the material of the box is a card sheet that is at least 2 mm thick.

26. A box according to claim 25, wherein said card sheet is plasticized.

27. A box comprising a body having a front panel and a rear panel interconnected by two side panels, the side panels and the front and rear panels being made by folding a sheet material, the body of the box having at least one opening with an associated closure device, said closure device comprising two side flaps each extending the respective lateral panel via a respective fold, each side flap having a front edge situated adjacent to the front panel, the closure device also comprising a closure flap formed to extend the rear panel, said closure flap having a cover-forming portion for folding down onto the side flaps and a tongue for inserting between the front panel and the front edges of the side flaps when the closure device is in its closed configuration, the tongue having an inside face facing the rear panel when the closure device is in its closed configuration, the tongue including at least one abutment-forming surface beside the inside face of the tongue and suitable for projecting beneath the side flaps when the closure device is in its closed configuration, wherein the abutment-forming surface is constituted by a portion of the tongue that is folded down onto itself, said side flaps being independent of the closure flap and said side flaps being arranged to fold down into the opening of the body of the box without overlapping each other.

28. A box according to claim 27, wherein each cutout defines a tab in a region of each side flap which is adjacent to a distal edge of said side flap and to a front edge of said side flap, beneath which tab the abutment-forming surface is suitable for coming into abutment.

29. A box according to claim 27, wherein each cutout defines a tab in a region of each side flap which is adjacent to a proximal end of said side flap and to a front edge of said side flap, beneath which tab the abutment-forming surface is suitable for coming into abutment.

30. A box according to claim 27, in which each side flap is connected via a proximal end to the associated side panel, each side flap has a distal edge, and wherein the distal edges of the side flaps come substantially into contact when the closure device is in its closed configuration.

31. A box according to claim 27, wherein the abutment-forming surface extends over substantially the entire width of the tongue.

32. A box according to claim 27, in which the cover-forming portion is connected via a proximal end to the rear panel and via a distal end to the tongue, and wherein the abutment-forming surface is situated close to the distal end of the cover-forming portion.

33. A box according to claim 27, wherein the body of the box has a second opening with a second associated closure device identical to the at least one opening with the associated closure device.

34. A box according to claim 27, wherein the material of the box is a card sheet that is at lead 2 mm thick.

35. A box according to claim 34, wherein said card sheet is plasticized.

* * * * *